US005179808A

United States Patent [19]

Bakanowsky, III

[11] Patent Number: 5,179,808

[45] Date of Patent: Jan. 19, 1993

[54] VIDEO GAME OR COMPUTER CLEANING CARTRIDGE

[75] Inventor: Louis J. Bakanowsky, III, Fitchburg, Mass.

[73] Assignee: Curtis Manufacturing Company, Inc., Jaffrey, N.H.

[21] Appl. No.: 900,416

[22] Filed: Jun. 18, 1992

Related U.S. Application Data

[63] Continuation-in-part of Ser. No. 743,598, Aug. 12, 1991, and a continuation-in-part of Ser. No. 721,163, Jun. 26, 1991, Pat. No. 5,144,775.

[51] Int. Cl.[5] ..... B08B 1/00; B24B 27/033

[52] U.S. Cl. ..... 51/205 WG; 51/392; 51/205 R; 15/210.1

[58] Field of Search ..... 51/57, 59 R, 281 R, 51/358, 381, 392, 393, 205 R, 205 WG; 15/104.92, 104.93, 104.99, 210 R, 118; 134/6, 8, 22.1

[56] References Cited

U.S. PATENT DOCUMENTS

| | | | |
|---|---|---|---|
| 3,807,010 | 4/1974 | Semrad | 15/210 R |
| 3,956,789 | 5/1976 | Shultz | 51/59 R |
| 4,428,092 | 1/1984 | Lipari | 15/246 |
| 4,951,425 | 8/1990 | Naghi | 15/210 R |
| 4,993,100 | 2/1991 | Halboth | 15/210 R |
| 5,025,526 | 6/1991 | Ichitsubo | 15/210 R |

*Primary Examiner*—Bruce M. Kisliuk
*Assistant Examiner*—Jack Lavinder
*Attorney, Agent, or Firm*—Richard P. Crowley

[57] ABSTRACT

A cleaning cartridge device for cleaning the electrical contacts with a computer video game cartridge receptacle 92. The device includes a housing for insertion in the cartridge receptacle 92, a board 56 with cleaning material at the one end 82 within the housing, the board 56 having a handle end 76 extending from one end of the housing, and the board 56 slidably movable by the use of the handle end 76 between defined stop positions of a cleaning position for the electrical contacts with the cleaning material in contact with the electrical contacts and a non-cleaning position spaced apart from the electrical contacts.

12 Claims, 2 Drawing Sheets

VIDEO GAME OR COMPUTER CLEANING CARTRIDGE

REFERENCE TO PRIOR APPLICATION

This application is a continuation-in-part of U.S. patent application Ser. No. 07/743,598, filed Aug. 12, 1991 still pending, entitled VIDEO GAME OR COMPUTER CLEANING CARTRIDGE, and of U.S. patent application Ser. No. 07/721,163, filed Jun. 26, 1991, now U.S. Pat. No. 5144775 CLEANING CARTRIDGE AND METHOD FOR COMPUTER AND VIDEO GAMES, hereby incorporated by reference in their entireties. The parent application is directed toward a cleaning cartridge for cleaning electrical contacts of the connector block within a computer video game cartridge receptacle. The cleaning cartridge comprises a housing configured to be inserted and to be fitted within said cartridge receptacle and typically comprises two molded plastic half sections which are secured together to form the housing. The cartridge also includes a board means, such as a flat, planar board means, having a one end and the other end with the board means located for slidable movement within the housing and wherein the housing encloses a portion of the board means. One end of the planar board means extends outwardly from an elongated slot at one end of the housing and is adapted to be grasped by an operator so that the board means may be moved between a cleaning and a non-cleaning position. The other end is adapted to fit on the opposite side of a recess within the housing, the recess placed around the electrical contacts, and the other end having at least one surface, and typically, two flat surfaces and an edge containing thereon a cleaning material, such as an abrasive-type cleaning material, adapted to be placed in contact with the electrical contacts so that on repeated movement of the planar board means, the electrical contacts are abrasively cleaned. Within the housing are grooves and tracks and supporting ribs so as to provide for a basis for the guided, slidable movement of the planar board between an extended position wherein the other end of the planar board is in a cleaning position in contact or adjacent the electrical contacts in a non-cleaning position wherein the board is retracted and still within the housing and out of direct contact with the electrical contacts. The cleaning cartridge of the parent application permits the replacement of a section of the planar board means or of the board means itself by an operator when the cleaning section has been rendered partially or wholly ineffective.

BACKGROUND OF THE INVENTION

Computers, such as personal computers, and a wide variety of video game systems, such as the Nintendo ® game system and the hand-held, portable Game Boy ® systems (Nintendo and Game Boy are registered trademarks of Nintendo of America, Inc.) are adapted to receive computer and video game cartridges within a program cartridge receptacle. Generally, the cartridge comprises a printed circuit board enclosed within a housing, the housing adapted to fit within the cartridge receptacle. For example, in the Nintendo ® video game system, typically the game cartridge is inserted within the cartridge receptacle and then pushed downwardly by the user to lock the cartridge in place, and then the cartridge after use is released by downward pressure to spring into an upward position. In the portable Game Boy ®, the game cartridge may merely just be inserted within the cartridge receptacle. The printed circuit boards of the cartridges employed are electrically connected to the electronic system of a computer video game system when the cartridge is inserted in the cartridge receptacle The electrical contacts within the computer video game systems often acquire dust, dirt, oil and oxidation and other debris detrimental to the efficient operation of the electrical contacts from the frequent use of the cartridges into the cartridge receptacle. Such debris adversely effects the electrical surface performance of the computer video game system, so that the efficient and frequent cleaning of the electrical contacts is a desirable procedure.

Generally, the employment of alcohol or other solvents via swab-type methods or by the employment of hand-held cleaning, polishing or burnishing tools is awkward and not easily accomplished by users.

A computer and video game cleaning cartridge has been disclosed in U.S. Pat. No. 4,951,425, issued Aug. 28, 1990 in which a cleaning cartridge is inserted into a receptacle and burnishing material at one end of a planar board provides for the cleaning of the electrical contacts of the connector block when the cartridge is inserted in place. Such a cleaning cartridge requires replacement of the entire cartridge when the burnishing material on the board has been used or deteriorated, and further, such cleaning cartridge immediately places the burnishing materials into a cleaning position upon insertion of the cartridge into the cartridge receptacle.

It is desirable to provide for a new, inexpensive, flexible cleaning cartridge and method in which the cleaning cartridge in the cartridge receptacle may be placed in a non-cleaning or cleaning position by the user and by which the boards containing the polishing, cleaning or burnishing materials may be easily and readily replaced by the user without replacement of the entire cartridge and to provide other advantages.

SUMMARY OF THE INVENTION

The present invention is directed to a cleaning cartridge for computer video games and to a method of cleaning electrical contacts of a connector block within the cartridge receptacle of a computer video game system.

In a further embodiment of the invention, there has been provided a cleaning cartridge for cleaning the electrical contacts within a computer video game cartridge receptacle, particularly of a hand-held, battery-operated, portable computer game with a screen, such as a Game Boy ® apparatus. The cleaning cartridge comprises a housing typically composed of two plastic molded half sections, wherein in one embodiment the housing has at one end an elongated opening, a recessed slot within the opening, the elongated opening adapted to be inserted within the cartridge receptacle and an opposite end containing the elongated slot wherein the half sections of the housing are adapted to be snapped together or pinched together in a releasable manner so that the board means within the housing may be easily inserted or replaced by an operator.

At least one of these housing sections includes a pair of raised rib sections generally parallel and spaced apart generally extending between the two elongated slots of the housing. At least one of these sections also has side guide walls and a transverse ridge to guide the planar board means. Both sections include a pair of spaced apart guide notches adapted to receive therein raised ridges of the outside edges of the planar board means so as to act as a further guide for the slidable movement of the planar board means in said guide ridges between a cleaning and a non-cleaning position.

The planar board means has a pair of spaced apart, elongated apertures therein so designed and configured so as to be placed slidably over the raised ribs in the housing section. The apertures are of a length greater than that of the raised ribs in the housing section by the distance between the cleaning and non-cleaning positions so as to define the length of the movement between cleaning and non-cleaning positions within the housing. The planar board also contains a short, flat section having an abrasive material, typically on one surface, but more typically on both surfaces and on the edge, and generally by employment of placing a tape containing abrasive material on the flat surfaces and edge surfaces on this section of the planar board means. The other end of the planar board means typically extends out of the elongated slot within the housing and serves as a handle so that the operator may by grasping the handle move the board means slidably within the housing between the respective positions, so that on the cleaning operation, the operator after inserting the housing in the cartridge receptacle may push the planar board or the board means forward into a cleaning position and by backward and forward movement clean the electrical contacts. The cleaning cartridge of the invention may typically be employed in a cleaning-type kit which would include a cleaning cartridge together with one or more extra cleaning boards and replacement tips for the cleaning boards.

In the one preferred embodiment, the housing comprises two sections, which on being snap-fashioned together to form the housing about the cleaning board, form together the guide notches upon respective raised ribs for the slidable movement of the cleaning board within the cartridge.

The invention will be described for the purposes of illustration only in connection with certain embodiments; however, it is recognized that various changes, modifications, additions and improvements may be made by those persons skilled in the art to the illustrated embodiments.

DESCRIPTION OF THE EMBODIMENTS

Figure 1:
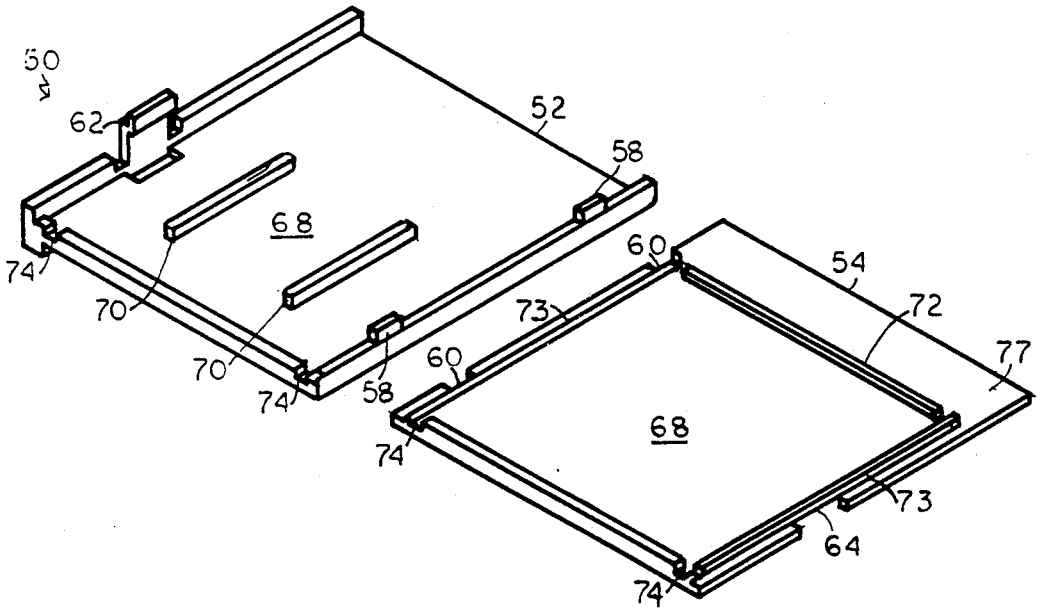
FIG. 1 is a top plan view of the top and bottom housing sections of the cleaning cartridge of the invention in open position without the planar board means.
Figure 2:
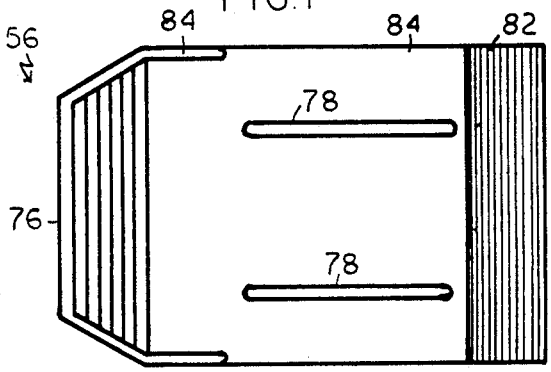
FIG. 2 is a top plan view of a planar board means for use in the cleaning cartridge of FIG. 1, with the other side being the same.

With reference to the drawings, the cleaning device of the invention comprises a cartridge 50 and a planar board means 56. Cartridge bottom 52 and cartridge top 54 are releasably attached by hinges formed by hinge extensions 58 and hinge receptors 60 and by latch extension 62 and latch receptor 64. Cartridge bottom 52 has lateral wall 68 with vertical slides 70. Cartridge top 54 has front guide 72 and side guides 73. Both cartridge bottom 52 and cartridge top 54 have guide notches 74 for planar board guides 84. Cartridge 50 has opening 77 on one side for engaging with the computer video game (see Fig. 5).

Planar board means 56 is placed between cartridge bottom 52 and cartridge top 54. At one end is planar board handle 76 that projects beyond the rear of cartridge 50. Planar board guides 84 are guided by guide notches 74. Planar board means 56 has one or more parallel, elongated apertures 78 which fit over vertical slides 70 and have a greater length. At the front end of planar board means 56 is cleaning end 82 that has electrical contact cleaning material on its surface.

In operation, cartridge 50 is inserted into the computer video game in the same manner as a program cartridge. Planar board means 56 is moved forward and backward by planar board handle 76. Forward and backward movement is limited by the contact of the ends of aperture 78 with the front and rear edges of vertical slide 70.

More particularly, cartridge 50 consists of a cartridge bottom 52 and a cartridge top 54. The external dimensions of cartridge 50 are such as to permit cartridge 50 to be inserted into the cartridge receptor 92 of the computer video game, such as the Game Boy ® apparatus 90, where the electrical contacts are to be cleaned, with the top surface of top section 54 having raised transverse ridge 94 thereon to stop and position the cleaning cartridge 50 correctly within the receptacle 92. On a first side edge of cartridge bottom 52 there is at least one, and, preferably, more than one, hinge extension 58 and, on the opposing second side edge of cartridge bottom 52, at least one latch extension 62, said hinge extension 58 and latch extension 62 projecting above the top surface of the side edge of cartridge bottom 52. On the corresponding first side edge of cartridge top 54 there are hinge receptors 60 that correspond to hinge extensions 58 and, at the opposing second side edge of cartridge top 54, latch snap in receptor 64 that corresponds to latch extension 62. When cartridge top 54 is matingly engaged to cartridge bottom 52 to form cartridge 50 (see FIG. 5), hinge extensions 58 are matingly engaged in hinge receptors 60. Latch extension 62 then is snapped or pinched in place in latch receptor 64. If desired, cartridge bottom 52 and cartridge top 54 each may contain both extension and receptor elements with corresponding receptor and extension elements on the other cartridge section. Further, if desired, hinge extensions 58 and hinge receptors 60 can be replaced by a single integrated hinge means, such as a web of plastic or a flexible material, so that cartridge 50 is a single unit.

Cartridge bottom 52 and cartridge top 54 include a series of ribs, ridges and guides in the interior of cartridge 50 raised from lateral wall 68. These include at least one, and, preferably, more than one, such as a pair of, vertical slides 70 and at least one front guide 72. These serve to guide planar board means 56 and also may provide structural support for cartridge 50.

Vertical slides 70 are perpendicular to the elongated, recessed opening 77. When there is more than one vertical slide 70, they generally are parallel to each other and are spaced so as to restrict lateral movement of planar board means 56, being parallel to apertures 78 on planar board means 56. Vertical slide 70 is shown as being in cartridge bottom 52. Vertical slides 70 are shorter in length and width than apertures 78 on planar board means 56, so that vertical slides 70 can fit inside apertures 78 and define a short space to permit movement of planar board means 56 between cleaning and non-cleaning positions. Front guide 72 is a transverse ridge that limits movement of the planar board means out of a single plane.

Cartridge 50 includes on its front edge an elongated, recessed opening 77. Cartridge bottom 52 and cartridge top 54 include on their rear edges an opening for the rear section of planar board means 56. At the ends of said opening are guide notches 74 to guide planar board guides 84 of planar board means 56. In operation, the rear portion of planar board means 56 extends rearward of cartridge 50, fitting into an elongated slot between guide notches 74, said extension being adapted to serve as planar board handle 76. Side guides 73 also assist in aligning planar board means 56 and in limiting lateral movement thereof.

Planar board means 56 includes one or more apertures 78 that correspond to the number of vertical slides 70. The length and position of vertical slides 70 and apertures 78 are determined by the distance between cleaning and non-cleaning positions. Apertures 78 are positioned so that vertical slides 70 can be inserted into the apertures. Planar board means 56 also has cleaning end 82, adapted to conform to the cartridge section of the computer video game, and having cleaning material on at lease one, but preferably both, sides and the edge thereof. Typically, this cleaning material is an abrasive substance. Such abrasive materials may be applied to cleaning end 82 by use of a tape containing the abrasive material, such as a nylon tape, which may be wrapped around cleaning end 82, covering both sides and the edge thereof. Use of such tape has the added advantage of being replaceable, so that when the tape becomes worn out, the tape can be replaced, rather than the entire planar board means 56 or the entire cartridge.

Figure 5:
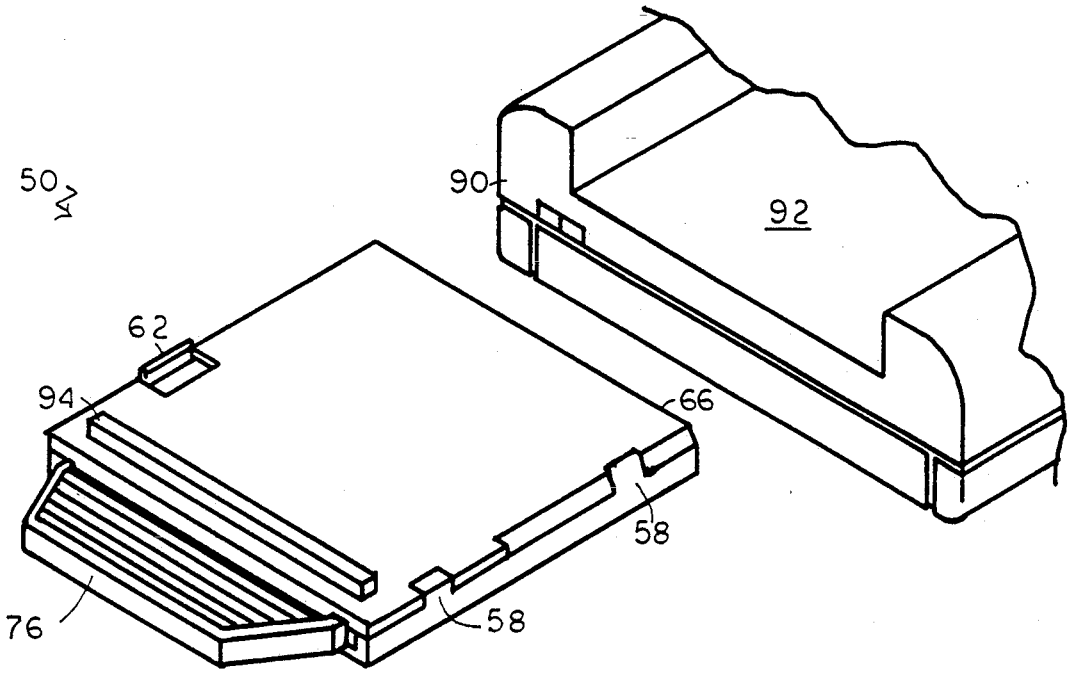
FIG. 5 is a perspective view from above of the assembled cleaning cartridge of FIG. 1 in a non-cleaning position adjacent and ready to be inserted with a cartridge receptacle of a hand-held computer video game apparatus.

The cleaning cartridge is assembled as in FIG. 5 by placing planar board means 56 in cartridge bottom 52 so that vertical slides 70 fit through apertures 78, and planar board guides 84 are aligned in guide notches 74 with planar board handle 76 projecting out rearward of cartridge bottom 52 in an elongated slot beside guide notches 74. Side guides 73 also limit lateral movement of planar board means 56. Front guide 72 keeps planar board means 56 in alignment in the plane. Cartridge top 54 then is placed on top of cartridge bottom 52 with planar board means 56 in the middle, and cartridge bottom 52 and cartridge top 54 are releasably fastened to each other first by having hinge extensions 58 matingly engaged in hinge receptors 60, then by having latch extension 62 snapped or pinched into place in latch receptor 64.

Figure 3:
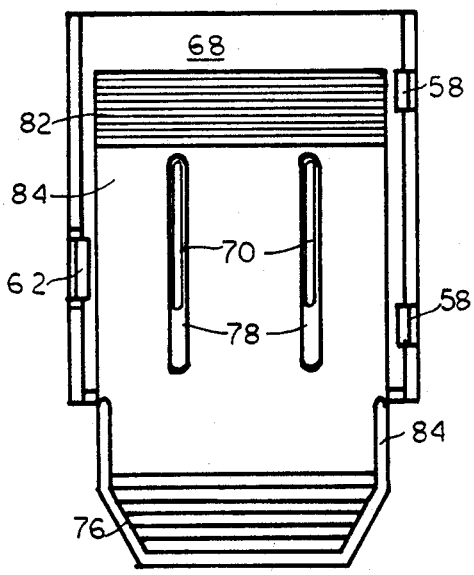
FIG. 3 is a top plan view of the planar board means of FIG. 2 in a non-cleaning position within the bottom half housing section of the cleaning cartridge of FIG. 1.
Figure 4:
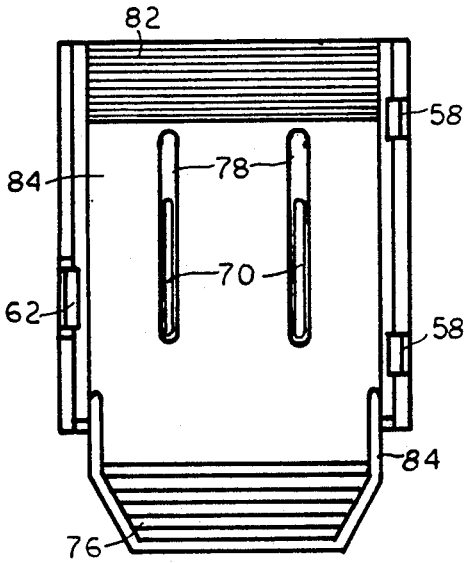
FIG. 4 is top plan view of the planar board means of FIG. 2 in a cleaning position within the bottom half housing section of the cartridge of FIG. 1.

When assembled, planar board means 56 may be moved forward and backward, that is, forward to a cleaning position and backward to a non-cleaning position. When engaged into a cleaning position, planar board means 56 is pushed forward by means of planar board handle 76 until the rear end of aperture 78 is in contact with the rear of vertical slide 70. This position is shown in FIG. 4. When withdrawn to a non-cleaning position, planar board means 56 is pulled backward by means of planar board handle 76 until front of aperture 78 is in contact with the front of vertical slide 70. This position is shown in FIG. 3.

In operation, cartridge 50 is inserted in the cartridge receptacle 92 of the computer video game 90. The side containing elongated opening 77 is inserted first. Cleaning of the electrical contacts in the computer is accomplished by movement of planar board means 56 so as to alternately place it in a cleaning, then a non-cleaning position. Planar board handle 76 is pushed to engage planar board means 56 in the cleaning position and pulled to retract planar board means 56 to the non-cleaning position. When engaged into the cleaning position, cleaning end 82 is placed adjacent to or in contact with the electrical contacts of the computer video game. Movement of cleaning end 82 causes abrasion or friction to occur between it and the electrical contacts of the computer video game, said abrasion or friction acting to clean said electrical contacts of dirt, dust, oil, oxidation and other debris. This abrasion or friction may be desirably enhanced by the addition of abrasives to cleaning end 82, preferably to both the top and bottom sides and the edge thereof. Abrasives can be added to cleaning end 82 by the use of abrasive nylon tape, folded around cleaning end 82. In use, cleaning of the electrical contacts is accomplished by the insertion of cartridge 50 in the computer video game and one or more cycles of moving planar board means 56 from a non-cleaning position to a cleaning position and back to a non-cleaning position. Sequences of between six and twelve cycles have been found to be effective.

When, after use, cleaning end 82 has deteriorated, or itself has become contaminated with dust, dirt, oil and other debris, the cleaning end can be cleaned. With the device of the invention removed from the computer video game, and planar board means 56 engaged in the cleaning position, a wand, swab or brush may be used to clean cleaning end 82. Cleaning also may be accomplished by disassembling the cleaning device, removing planar board means 56 and using a wand, swab, brush or other cleaning means to clean cleaning end 82.

When cleaning end 82 has deteriorated from use, including when the abrasives have worn away, the cleaning device may be disassembled, planar board means 56 removed, a replacement planar board means put in its place and the cleaning device reassembled. It also is possible, where nylon tape or other similar material is used to add abrasives to cleaning end 82, to disassemble the device, remove planar board means 56, remove from cleaning end 82 the tape and replace it with new tape, and reassemble the device.

What is claimed is:

1. A cleaning cartridge device for cleaning electrical contacts within a computer video game receptacle, which device comprises:

a) a cartridge composed of one or more sections, said cartridge having an elongated opening on a first side to be mounted within the computer video game receptacle adjacent to the electrical contacts therein;

b) a planar board means, a portion of which is positioned within the cartridge, said planar board means capable of being moved therein between a cleaning and non-cleaning position;

c) the planar board means having a cleaning surface at the one end and a handle means at the other, said handle means projecting rearward of said cartridge through an elongated slot on a second side of said cartridge opposite said first side; and;

d) stop means in the cleaning cartridge device to prevent the movement of the planar board means past the cleaning and non-cleaning positions, said stop means including one or more apertures in the planar board means and one or more corresponding parallel spaced guide rails on the cartridge, said apertures receive said guide rails for guiding the board means during movement between the cleaning and non-cleaning positions, whereby the electrical contacts are cleaned by the movement of the cleaning surface when the planar board means is moved between the cleaning and non-cleaning positions.

2. The device of claim 1 wherein the cartridge comprises a top and a bottom section, and means to secure releasably the sections together to form the cartridge.

3. The device of claim 2 having latch and hinge means to secure the sections of the cartridge releasably together.

4. The device of claim 1 wherein the planar board means has ridges along its side edges, and the cartridge has guide notches for receiving said ridges .

5. The device of claim 1 wherein the cleaning surface of the planar board means has abrasive materials thereon.

6. The device of claim 5 wherein tape means are used to place the abrasive materials on the cleaning surface.

7. The device of claim 1 wherein guide rails in the cartridge limit lateral movement of the planar board means.

8. The device of claim 1 wherein forward movement of the planar board means is stopped in the cleaning position by the contact a rearward end of said aperture with a rearward end of said guide rail.

9. The device of claim 1 wherein backward movement of the planar board means is stopped in the non-cleaning position by the contact of a forward end of said aperture with a forward end of said guide rail.

10. In combination, a computer video game apparatus having a cartridge receptacle with electrical contacts therein, and the device of claim 1 inserted within the cartridge receptacle.

11. A device for cleaning electrical contacts within a computer video game receptacle, which device comprises:

a) a cartridge composed of two sections having an opening on a first side for mounting within the computer video game receptacle adjacent to electrical contacts therein and means to secure the two sections of the cartridge releasably together;

b) the cartridge having one or more spaced guide rails, perpendicular to the first side;

c) a removable planar board means positioned within the cartridge capable of being moved therein between a cleaning and a non-cleaning position, one end and said board means forming a handle extending from the cartridge and the other end thereof having a cleaning surface thereon, the board means having one or more apertures perpendicular to said cleaning surface, the planar board means being positioned in the cartridge so that the spaced guide rails of the cartridge fit matingly into said aperture, thereby restricting lateral movement of the planar board means;

d) the planar board means having ridges along its side edges, and said cartridge having guide notches for receiving said ridges; and e) stop means to prevent movement of the planar board means past the cleaning and non-cleaning positions, wherein forward movement of the planar board means is stopped in the cleaning position by the contact of a rearward edge of the aperture with a rearward edge of the cartridge guide rail and backward movement of the planar board means is stopped in the non-cleaning position by the contact of a forward edge of the aperture with a forward edge of the cartridge guide rail, whereby electrical contacts are cleaned by the movement of the cleaning surface when the planar board means is moved between the cleaning and non-cleaning position.

12. The device of claim 11 wherein the planar board cleaning surface comprises a tape means to place abrasive materials on the cleaning surface.

* * * * *

UNITED STATES PATENT AND TRADEMARK OFFICE

CERTIFICATE OF CORRECTION

PATENT NO. : 5,179,808

DATED : January 19, 1993

INVENTOR(S) : Louis J. Bakanowsky, III

It is certified that error appears in the above-identified patent and that said Letters Patent is hereby corrected as shown below:

Column 7, line 37, after "contact" insert --of--.

Signed and Sealed this

Twenty-sixth Day of October, 1993

*Attest:*

Bruce Lehman

BRUCE LEHMAN

*Attesting Officer*

*Commissioner of Patents and Trademarks*